United States Patent [19]

Sengewald

[11] Patent Number: 4,779,996

[45] Date of Patent: Oct. 25, 1988

[54] POUCH WITH SLOTTED SUSPENSION MEANS

[76] Inventor: Karl-Heinz Sengewald, Postfach 1460, 4802 Halle in Westfalen 1, Fed. Rep. of Germany

[21] Appl. No.: 3,920

[22] Filed: Jan. 16, 1987

Related U.S. Application Data

[63] Continuation-in-part of Ser. No. 540,606, Oct. 7, 1983, abandoned.

[30] Foreign Application Priority Data

Nov. 18, 1982 [DE] Fed. Rep. of Germany ..... 3242510
Nov. 20, 1982 [DE] Fed. Rep. of Germany ..... 3242976
Jun. 16, 1983 [DE] Fed. Rep. of Germany ..... 3321808

[51] Int. Cl.[4] ..... B65D 33/14

[52] U.S. Cl. ..... 383/9; 206/554; 206/806; 383/27; 383/120

[58] Field of Search ..... 383/25, 26, 27, 29, 383/120, 22, 9; 206/554, 806

[56] References Cited

U.S. PATENT DOCUMENTS 3,044,233 7/1962 Altman, Jr. ..... 206/554 X
3,338,398 8/1967 Altman, Jr. ..... 206/554 X
3,967,775 7/1976 Kramming ..... 206/554 X
4,177,919 12/1979 Soto ..... 383/27

FOREIGN PATENT DOCUMENTS 100277 5/1962 Norway ..... 206/806
365659 12/1962 Switzerland ..... 206/554
1016676 1/1966 United Kingdom ..... 206/554
1481439 7/1977 United Kingdom ..... 206/554

*Primary Examiner*—Stephen Marcus
*Assistant Examiner*—Bryon Gehman
*Attorney, Agent, or Firm*—Michael J. Striker

[57] ABSTRACT

A pouch comprises an upper wall, a lower wall, each of the walls having two longitudinal edges, a bottom edge and a top edge, elements for connecting the walls with one another so as to connect the side edges and the bottom edge of one of the walls with the side edges and the bottom edge of the other of the walls and to retain the top edges not connected with one another to form a filling opening, and elements for suspending the pouch and including at least one suspension opening and at least one slot provided in one of the walls and forming a bridge therebetween, and at least one suspension opening and at least one slot provided in the other of the side walls and directly communicating the one suspension opening with the top edge of the other of side walls.

5 Claims, 2 Drawing Sheets

FIG.4
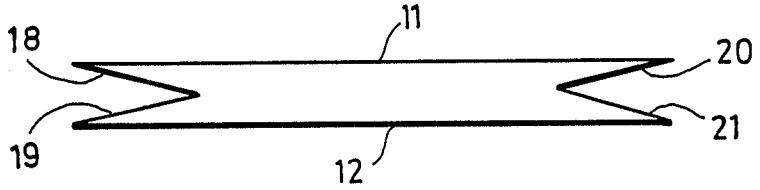
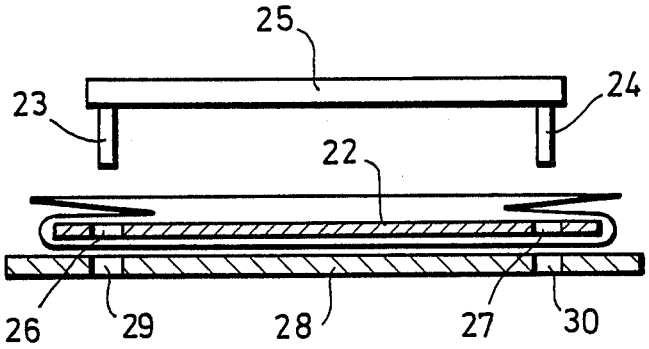
FIG.5

POUCH WITH SLOTTED SUSPENSION MEANS

CROSS-REFERENCE TO A RELATED APPLICATION

This application is a continuation-in-part of U.S. patent application Ser. No. 540,606, filed on Oct. 7, 1983, now abandoned.

BACKGROUND OF THE INVENTION

The present invention relates to a pouch. More particularly, it relates to a pouch of a synthetic plastic foil, which can be carried and torn off when being suspended.

Pouches of the above mentioned general type are known in the art. A known pouch includes an upper foil layer and a lower foil layer which are connected with one another by a welding seam for forming a pouch bottom and pouch sides. The lower foil layer is provided in the region of a filling opening with two suspension holes located near one another. A slot is formed between each suspension hole and an edge of the pouch so as to from a bridge between the slot and the suspension hole.

The suspension holes have two functions. Since the pouches after their production have to be stacked in order to be able to pack them as a stack, it has been proposed to fasten the pouches after their production on pins for providing a stacking. The pouches provided with suspension holes are also held on pins for their simplified delivery. These pins can be present in shops in order to allow a manual removal of one pouch from the pins for filling of the purchased goods into the pouch. The above mentioned pins are, however, also present in manufacturing plants for filling the pouches with the corresponding product, for example for packing bread or diapers. The removal of the pouches from the pins can be simply carried out by guiding upwardly the individual pouches along the pins so that the pouches are freed from the pins.

It is also possible to draw off the pouches by increased exertion of force from the pins from the plane transverse to the longitudinal extension of the pin and to tear open the bridge between the hole and the edge of the pouch. For guaranteeing a constant force, it has been proposed in the art to provide the pouch with an overflap as disclosed, for example in the U.S. Pat. No. 3,044,233. In this pouch a slot is provided between one suspension hole and the edge of the pouch, and a bridge is formed between the slot and the suspension hole. The bridge forms a definite weak point. Regardless of the distance of the hole from the edge of the pouch, the web can have an identical size, since different distances of the holes from the edge can be compensated by the length of the slot. The above mentioned suspension openings with the slots have been provided only in the overflap of the pouches.

SUMMARY OF THE INVENTION

Accordingly, it is an object of the present invention to provide a pouch which is an improvement of the existing pouches.

More particularly, it is an object of the present invention to provide a pouch which can be torn off and which has openings easy to handle and to produce and arranged in several foil layers, so that the pouch can be provided in a simple manner with suspension openings also in side folds.

In keeping with these objects and with others which will become apparent hereinafter, one feature of the present invention resides, briefly stated, in a pouch of the above mentioned general type in which a filling edge of an upper foil layer and a filling edge of the lower foil layer of a pouch in a flat condition coincide with one another, at least one suspension opening and at least one slot forming therebetween a bridge are provided in the lower foil layer, and the upper foil layer has also a suspension opening with a slot which communicates the suspension opening with the associated edge of the pouch.

When the pouch is designed in accordance with the present, the force for tearing off a pouch from the pins is independent from the fact whether the supsension holes are provided in one or several foil layers. The reason for this is that the suspension holes formed in only one foil layer are provided with the above mentioned bridge, while the suspension holes in the other foil layers do not have a bridge, but instead the slot connects the openings directly with the edge of the pouch. As a result of this, in these foil layers a certain force consumption is provided in these foil layers, which is however comparatively low.

With the inventive solution for the pouch it is possible to provide suspension holes also in pouches with side folds. If eight openings provided in such pouches, only two openings in one foil layer are blocked from the edge by a web.

In accordance with another feature of the present invention, instead of a slot which connects the opening with the edge of the pouch, the openings in the remaining foil layers extend directly to the filling edge and in an especially simple manner by the respective selection of a greater diameter. This solution is especially advantageous for pouches with side folds, wherein the openings are arranged in the side folds.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 4 is a view showing a section of the pouch of the present invention; and FIG. 5 is a view showing a device for producing suspension holes in the inventive pouch of FIG. 4.

DESCRIPTION OF PREFERRED EMBODIMENTS

Figure 1:
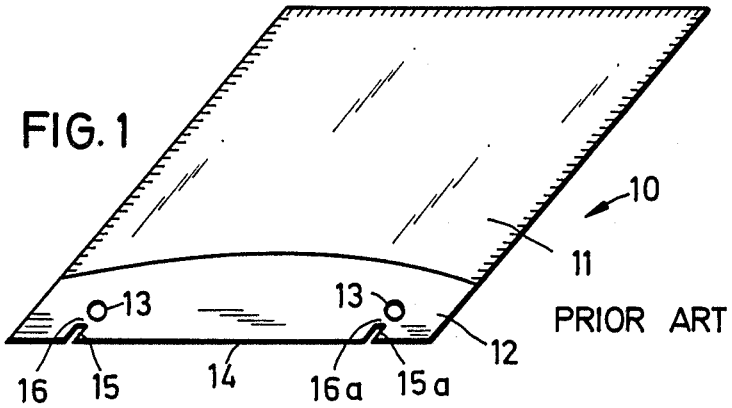
FIG. 1 is a perspective view of a suspendable pouch in accordance with the prior art.

FIG. 1 shows a known pouch which is identified with reference numeral 10 and composed of a thermoplastic synthetic foil. The pouch has an upper wall 11 and a lower wall 12 connected with one another along a bottom edge and two side edges. The wall 12 is longer than the wall 11 and forms therefore an overflap. Two openings 13 are formed near one another in the wall 12 and more particularly in the above mentioned overflap. The holes 13 are arranged at a distance from a filling edge 14 of the overflap.

The distance of the holes 13 from the edge 14 determines the force which is required for drawing a pouch from the pins. A slot 15 is provided between each suspension hole and the edge 14. The slot 15 ends shortly before the respective suspension openings 13 so as to form a bridge 16. The bridge 16 has a constant width. It is therefore guaranteed that the same force is required for tearing off the web.

Figure 2:
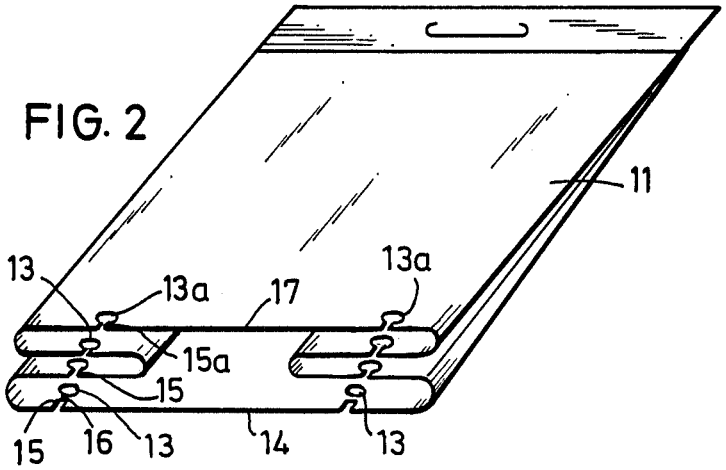
PRIOR ART FIG. 2
FIG. 2 is a perspective view showing a suspendable pouch with side folds in accordance with the present invention.

FIG. 2 shows a pouch in accordance with the present invention. Here a filling edge 14 of the lower wall 12 coincides in the flat condition of the pouch with a filling edge 17 of the upper wall 11. The pouch is provided with a plurality of side folds, and the filling edges of the side folds also coincide with the filling edges 14, 17 of the upper and lower walls 12, 11 in the flat condition of the pouch. The lower wall or foil layer 12 is provided with the above mentioned web 16 between each suspension opening 13 and each slot 15.

The upper wall or foil layer 11 is also provided with suspension openings **13*a* and slots 15. However, no bridges are formed in the upper wall since the slots 15 directly connect the openings 13*a* with the filling edge 17. As can be seen from FIG. 2, the side folds include two side folds 18 and 19 at one side and two side folds 20 and 21 at the other side of the pouch. All folds 18, 19, 20, 21 are provided with openings 13a and slots 15 formed so that each slot 15 directly connects a respective one of the openigns 13*a* with the edge 17 in the respective fold. In other words, the side folds also do not have webs 16**.

Figure 3:
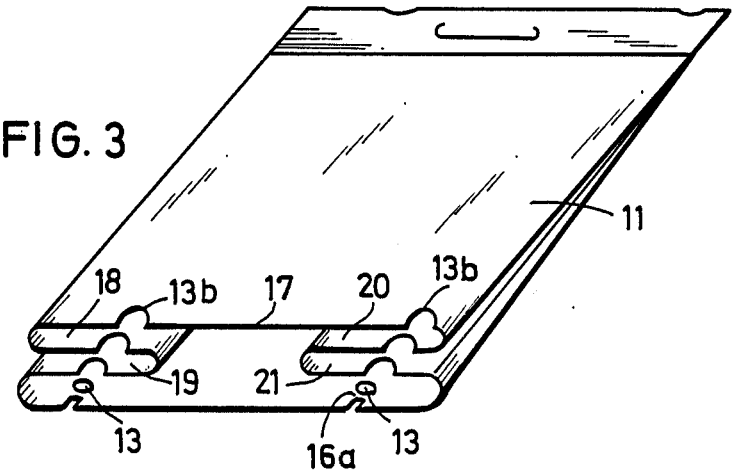
FIG. 3 is a perspective view of a suspendable pouch in accordance with another embodiment of the invention.

In accordance with an especially advantageous embodiment of the present invention shown in FIG. 3, the lower wall or foil layer 12 is again provided with the openings 13 which are associated with the bridges 16. However, the upper wall or foil layer 11 and the side folds 18, 19, 20, 21 do not have a web 16. The upper wall or foil layer 11 and the side folds 18, 19, 20, 21 are provided with openings **13*b* which have a greater diameter than the diameter of the openings 13 in the lower wall or foil layer 12. The openings 13*b* extend to the filling edge 17** or the front edges of the side folds.

FIG. 4 shows a hose with the side folds 18, 19 and 20, 21, in which the suspension openings are to be made.

FIG. 5 schematically shows a device for producing the suspension openings. A plate 22 is arranged in the hose, particularly between the side folds 19, 21 and the lower foil layer 12. The tool for producing the suspension openings has two punches 23 and 24 which are connected with one another by a transverse bar 25. The plate 22 is provided with through going openings 26 and 27 in the region of the punches 23 and 24. The device further includes a support 28 with associated through going openings 29 and 30. Thereby the upper foil layer 11 and the side folds 18, 19 and 20, 21 can be provided with suspension openings of a different diameter or with slots of a different length than in the lower foil layer 12.

As long as the pouch, for example the pouch shown in FIG. 3, must be provided with the suspension openings 13 in the wall 12 and the suspension openings **13*b* in the wall 11 and the side folds of a different diameter, the punches 23 and 24 can be formed stepped. More particularly, each punch can have a lower region with a smaller diameter so as to produce in the lower foil layer 12 the suspension openings of a smaller diameter, and the upper region with a greater diameter so as to produce the suspension openings of a greater diameter in the foil layers 11, 18, 19, 20, 21**.

It will be understood that each of the elements described above, or two or more together, may also find a useful application in other types of constructions differing from the types described above.

While the invention has been illustrated and described as embodied in a pouch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pouch of a synthetic plastic foil, comprising an upper wall; a lower wall, each of said walls having two longitudinal edges, a bottom edge and a top edge; means for connecting said walls with one another so as to connect said side edges and said bottom edge of one of said walls with said side edges and said bottom edge of the other of said walls and to retain the top edges not connected with one another to form a filling opening, one of said walls being provided with at least one suspension opening for suspending the pouch on a supporting structure and at least one slot extending from said top edge of said one wall but stopping shortly before said one opening to form a bridge between said one opening and said one slot, while the other of said walls has another opening and at least one slot extending from said another opening to said top edge of said other of said side wall so that a force required for tearing off of the pouch from the supporting structure is relatively low since it is needed to tear off substantially only said bridge of said one wall.

2. A pouch as defined in claim 1, wherein said top edge of one of said side walls and said top edge of the other of said side walls coincide with one another wherein said side walls lie flat over one another in a flat condition of the pouch.

3. A pouch as defined in claim 1; and further comprising at least two side folds provided between said side walls and including one side fold in the region of one of said longitudinal edges and another side fold in the region of the other of said longitudinal edges and each having a fold top edge, said other wall having a further opening and a further slot communicating said further opening with said top edge of said other wall so that said further opening does not perform suspending function, said other opening and other slot being provided in one of said side folds, while said further opening and said further slot are provided in the other of said side folds.

4. A pouch as defined in claim 1; and further comprising at least two side folds provided between said side walls and each arranged in the region of a respective one of said side edges and having a top fold edge, each of said side folds having an additional opening, said suspension opening in said one side wall having a predetermined diameter, said other opening in said other side wall and said additional opening in each of said side folds having a diameter which is greater than said diameter of said suspension opening in said one side wall, said other opening and said additional opening communicating with said top edge of said other wall and said top fold edge and do not perform suspending function.

5. A pouch as defined in claim 1, wherein said other opening in said other wall is circular.

* * * * *